US012357097B1

(12) United States Patent
Esham et al.

(10) Patent No.: US 12,357,097 B1
(45) Date of Patent: Jul. 15, 2025

(54) CONVERTIBLE SEATING FOR MARINE VESSELS

(71) Applicant: Brunswick Corporation, Mettawa, IL (US)

(72) Inventors: Noah S. Esham, Edgewater, FL (US); Kristin M. McGinnis, Cocoa Beach, FL (US); Spencer DeWitt Traynom, Port Orange, FL (US)

(73) Assignee: Brunswick Corporation, Mettawa, IL (US)

( * ) Notice: Subject to any disclaimer, the term of this patent is extended or adjusted under 35 U.S.C. 154(b) by 60 days.

(21) Appl. No.: 17/835,602

(22) Filed: Jun. 8, 2022

(51) Int. Cl.
*B63B 29/04* (2006.01)
*A47C 7/48* (2006.01)
*A47C 7/70* (2006.01)

(52) U.S. Cl.
CPC ..... *A47C 7/70* (2013.01); *A47C 7/48* (2013.01); *B63B 29/04* (2013.01); *B63B 2029/043* (2013.01)

(58) Field of Classification Search
CPC .. A47C 7/70; A47C 7/48; B63B 29/04; B63B 2029/043
See application file for complete search history.

(56) References Cited

U.S. PATENT DOCUMENTS 250,597 A 12/1881 St. John
427,413 A 5/1890 Fritz
831,877 A 9/1906 Kling
1,224,982 A 5/1917 Washeim
1,271,830 A 7/1918 Austin
1,782,231 A 11/1930 William et al.
1,792,737 A 2/1931 Greenstreet
2,076,309 A 4/1937 Whedon
2,113,346 A 4/1938 Heath
2,486,468 A 11/1949 Harry
2,900,009 A 8/1959 Haynes
(Continued)

FOREIGN PATENT DOCUMENTS

CN 109693587 3/2021
DE 19501521 7/1995
(Continued)

OTHER PUBLICATIONS

Chris-Craft, Catalina 24. Retrieved from the web: https://www.chriscraft.com/models/catalina-series/catalina-24/ on Jan. 11, 2022.
(Continued)

*Primary Examiner* — Philip F Gabler
(74) *Attorney, Agent, or Firm* — Andrus Intellectual Property Law, LLP

(57) ABSTRACT

A convertible seat for a marine vessel includes a seat base having a seat bottom and a seat back which extends transversely upwardly relative to the seat bottom, a back supporting cushion for an occupant seated on the seat bottom, a table coupled to the back supporting cushion, and a pivot mechanism which couples the table to the seat back, the pivot mechanism being configured such that the back supporting cushion and the table are movable into a storage position in which the table is sandwiched between the seat back and the back supporting cushion and a deployed position in which the table provides a supporting surface over the seat bottom.

7 Claims, 7 Drawing Sheets

(56) References Cited

U.S. PATENT DOCUMENTS 2,969,107 A 1/1961 Ira et al.
3,107,940 A 10/1963 Brooks et al.
3,379,471 A 4/1968 Dalziel
3,482,870 A 12/1969 Janssen
3,506,303 A 4/1970 Smittle et al.
3,643,528 A 2/1972 Van Der Loos
3,743,350 A 7/1973 Allen
3,839,757 A 10/1974 Grimes
3,877,747 A 4/1975 Brennan et al.
3,884,522 A 5/1975 Arima et al.
4,030,436 A 6/1977 Stoberl
4,088,040 A 5/1978 Ross-Myring
4,099,768 A 7/1978 Amos
4,536,027 A 8/1985 Brennan
4,558,901 A 12/1985 Yokoyama
4,567,845 A 2/1986 Smith
4,693,204 A 9/1987 Klein
4,736,982 A 4/1988 Hwang
4,738,217 A 4/1988 Smith
4,775,187 A 10/1988 Herr
4,843,999 A 7/1989 Kobus et al.
4,854,261 A 8/1989 Goldsmith
4,926,783 A 5/1990 Lathers
5,052,076 A 10/1991 Spaeth
5,052,748 A 10/1991 Fourrey et al.
5,054,857 A 10/1991 Kvalheim
5,107,720 A 4/1992 Hatfield
5,136,963 A 8/1992 Zuzik
5,171,064 A 12/1992 Boussaroque
5,261,727 A 11/1993 Klaebel
5,303,976 A * 4/1994 Nobile ..... A47C 17/02 297/146
5,313,033 A 5/1994 Link et al.
5,320,059 A 6/1994 Ikeda
5,329,871 A 7/1994 Gibbs
5,374,108 A 12/1994 Saul et al.
5,375,907 A 12/1994 Rogers et al.
5,381,585 A 1/1995 Olson et al.
5,531,506 A 7/1996 Scott
5,553,920 A 9/1996 Meschkat et al.
5,613,662 A 3/1997 Blackmore et al.
5,762,402 A 6/1998 Gillotti
5,782,534 A 7/1998 Desanta
5,799,605 A 9/1998 Huse
5,842,743 A * 12/1998 Wright ..... A47C 7/70 297/378.1
5,904,401 A 5/1999 Alberda et al.
5,913,571 A 6/1999 Dystra et al.
5,976,160 A 11/1999 Crainich
6,196,629 B1 3/2001 Onishi et al.
6,230,648 B1 5/2001 Davidson et al.
6,257,667 B1 7/2001 Boren et al.
6,283,059 B1 9/2001 Scully, Jr.
6,527,341 B1 3/2003 Martin
D481,986 S 11/2003 Menne
6,647,916 B2 11/2003 Neese et al.
6,766,759 B2 7/2004 Eck et al.
6,789,494 B2 9/2004 Neese et al.
6,866,022 B1 3/2005 Phillips et al.
6,880,482 B2 4/2005 Huse
6,883,458 B2 4/2005 Huse
6,918,160 B1 7/2005 Clark
6,940,026 B2 9/2005 Rundell et al.
6,945,190 B1 9/2005 Frandsen
7,000,557 B1 2/2006 Forbes et al.
7,107,927 B2 9/2006 Hopper et al.
7,121,218 B2 10/2006 Stinson et al.
7,156,442 B2 1/2007 McManus
7,172,252 B2 2/2007 Henning
7,255,058 B2 8/2007 Forbes et al.
7,302,906 B2 12/2007 Burroughs et al.
7,341,306 B1 3/2008 Neese et al.
7,367,616 B2 5/2008 Summerford
7,513,211 B1 4/2009 Farb et al.
7,647,880 B2 1/2010 Devine
7,661,382 B2 2/2010 Wood et al.
7,677,668 B2 3/2010 Olsen et al.
7,699,390 B2 4/2010 Baumann
7,819,483 B2 10/2010 Kushner et al.
7,828,383 B1 11/2010 Urbanek et al.
8,002,350 B2 8/2011 Johnson
8,028,641 B1 10/2011 Sly
8,109,563 B2 2/2012 Hansen
8,113,136 B2 2/2012 Mayrand et al.
8,113,137 B2 2/2012 Thompson
8,113,589 B2 2/2012 Mildt et al.
8,499,377 B2 8/2013 Fafard et al.
8,517,466 B1 8/2013 Wizorek et al.
8,720,990 B2 5/2014 Boydston
8,740,297 B1 6/2014 Foss et al.
8,801,099 B2 8/2014 Ebel et al.
8,840,175 B2 9/2014 Short
8,899,169 B1 12/2014 Jaziri
9,021,975 B1 5/2015 Fodor et al.
9,067,517 B1 6/2015 Roeglin et al.
9,073,608 B1 7/2015 Foss et al.
D743,318 S 11/2015 Curts
9,260,166 B1 2/2016 Fodor et al.
9,315,238 B2 4/2016 Neese et al.
9,370,245 B2 6/2016 Fafard et al.
9,403,597 B2 8/2016 Ferry et al.
9,440,560 B2 9/2016 Neese et al.
9,487,273 B1 11/2016 Eekhoff et al.
9,527,555 B2 12/2016 Ketterman et al.
9,650,117 B2 5/2017 Curts et al.
9,688,168 B2 * 6/2017 Gratz ..... B60N 2/309
9,701,368 B2 7/2017 Neese et al.
D794,537 S 8/2017 Wagnon
9,783,271 B2 10/2017 Foss et al.
9,821,887 B1 11/2017 Wilson et al.
9,907,404 B1 3/2018 Sorel et al.
9,919,625 B1 * 3/2018 Barbier ..... A47C 7/628
D819,540 S 6/2018 Wilson et al.
10,005,380 B2 6/2018 Reid et al.
D824,836 S 8/2018 Deurr
10,065,711 B2 9/2018 Fuller, IV et al.
10,065,713 B2 9/2018 Murphy
D830,944 S 10/2018 Deurr
10,085,566 B1 10/2018 Gallant
10,149,544 B2 12/2018 Fafard et al.
10,150,539 B1 12/2018 Wilson et al.
10,207,776 B1 2/2019 Downey et al.
10,328,836 B2 6/2019 Purwin et al.
10,422,167 B2 9/2019 Huerta et al.
D864,081 S 10/2019 Barbier et al.
10,464,639 B2 11/2019 Neese et al.
10,471,859 B2 11/2019 Harrison, III et al.
10,479,233 B2 11/2019 Minato et al.
10,486,777 B1 11/2019 Barbier et al.
D870,016 S 12/2019 Wilson et al.
10,494,061 B2 12/2019 Fafard et al.
10,556,645 B1 2/2020 Levin
10,569,841 B2 2/2020 Fuller, IV et al.
10,759,502 B2 9/2020 Fafard et al.
10,933,774 B2 3/2021 Curts
11,034,414 B1 6/2021 Wilson et al.
11,174,893 B1 11/2021 Freer et al.
11,195,368 B2 12/2021 Patel et al.
11,286,022 B1 3/2022 Freer
2003/0197402 A1 10/2003 McCutcheon et al.
2003/0218369 A1 11/2003 Akaike et al.
2006/0103174 A1 5/2006 Queveau et al.
2007/0114819 A1 5/2007 Dougherty
2007/0158986 A1 7/2007 Adams et al.
2008/0196649 A1 8/2008 Kalil
2008/0236452 A1 10/2008 Pratt et al.
2009/0261629 A1 10/2009 Fafard et al.
2009/0277372 A1 11/2009 Wood et al.
2010/0018451 A1 1/2010 Sahr
2010/0037813 A1 2/2010 Sahr et al.
2010/0037814 A1 2/2010 Sahr et al.
2010/0201163 A1 8/2010 Dunkel
2011/0057483 A1 3/2011 Dickey et al.
2011/0109136 A1 5/2011 Fafard et al.

(56) References Cited

U.S. PATENT DOCUMENTS

| | | | |
|---|---|---|---|
| 2011/0226900 | A1 | 9/2011 | Bamford et al. |
| 2014/0216327 | A1 | 8/2014 | Chen |
| 2014/0265500 | A1 | 9/2014 | Hough et al. |
| 2016/0152169 | A1 | 6/2016 | Zheng et al. |
| 2017/0233042 | A1 | 8/2017 | Curts et al. |
| 2019/0104849 | A1 | 4/2019 | Fafard et al. |
| 2020/0337467 | A1 | 10/2020 | Cannon |
| 2020/0398944 | A1 | 12/2020 | Fafard et al. |
| 2021/0169229 | A1 | 6/2021 | Niemela et al. |
| 2021/0214052 | A1 | 7/2021 | Mast |
| 2021/0298483 | A1* | 9/2021 | Donat ..... B63B 29/04 |
| 2022/0258835 | A1 | 8/2022 | Curts |

FOREIGN PATENT DOCUMENTS

| | | |
|---|---|---|
| DE | 60207263 | 7/2006 |
| DE | 102011086751 | 5/2013 |
| GB | 635957 | 4/1950 |
| WO | WO 2019222749 | 11/2019 |

OTHER PUBLICATIONS

Declaration of Prior Art signed by the inventors, 2022.

* cited by examiner

CONVERTIBLE SEATING FOR MARINE VESSELS

FIELD

The present disclosure relates to marine vessels and to convertible seating for marine vessels.

BACKGROUND

The following U.S. Patent is incorporated herein by reference in entirety.

U.S. Pat. No. 10,486,777 discloses a seating system having a base, and a seat mounted on the base and defining a seating surface. A backrest is configured for movement relative to the base and the seat between a first position and a second position by a backrest transfer arrangement having a movable pivot axis configuration. In the second position, the backrest defines a working surface spaced above and lying generally parallel to the seating surface.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

A convertible seat for a marine vessel includes a seat base having a seat bottom and a seat back which extends transversely upwardly relative to the seat bottom, a back supporting cushion for an occupant seated on the seat bottom, a table coupled to the back supporting cushion, and a pivot mechanism which couples the table to the seat back, the pivot mechanism being configured such that the back supporting cushion and the table are movable into a storage position in which the table is sandwiched between the seat back and the back supporting cushion and a deployed position in which the table provides a supporting surface over the seat bottom.

In non-limiting examples, the pivot mechanism has an upper pivot arm which is pivotably coupled to the base at a first inner pivot joint and to the table at a first outer pivot joint, and a lower pivot arm which is pivotably coupled to the base at a second inner pivot joint and pivotably coupled to the table at a second outer pivot joint.

In non-limiting examples, the convertible seat includes a base mounting bracket which mounts the pivot mechanism to the seat base, wherein together the mounting bracket, an upper pivot arm, a lower pivot arm, and the table constitute a four-bar mechanism.

In non-limiting examples, the pivot mechanism is one of first and second pivot mechanisms located on opposite sides of the table.

In non-limiting examples, the pivot mechanism is configured to facilitate pivoting of an upper portion of the seat cushion downwardly relative to the seat back, which pivots the table upwardly from the stored position to the deployed position.

In non-limiting examples, moving the convertible seat from the storage position to the deployed position pivots a first outer pivot joint and a second outer pivot joint upwardly and outwardly relative to the seat base and then brings the second outer pivot joint back inwardly towards the seat base.

In non-limiting examples, in the storage position, a lower pivot arm and an upper pivot arm are generally adjacent to and aligned with each other and the table.

BRIEF DESCRIPTION OF THE DRAWINGS

The present disclosure includes the following Figures.

DETAILED DESCRIPTION

In the present disclosure, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

In marine vessels that do not include a galley, it can be helpful to have the option to convert unnecessary seating into a tabletop workspace. The inventors recognized a need in the art for a compact pivot mechanism which can pivot a seat cushion into and out of a stored and deployed position without the need for a large pivot mechanism storage space. The present disclosure provides an improved pivot mechanism for a flip out seat cushion and table which provides countertop workspace in the interior of a marine vessel where a galley would have alternatively been.

Figure 1:
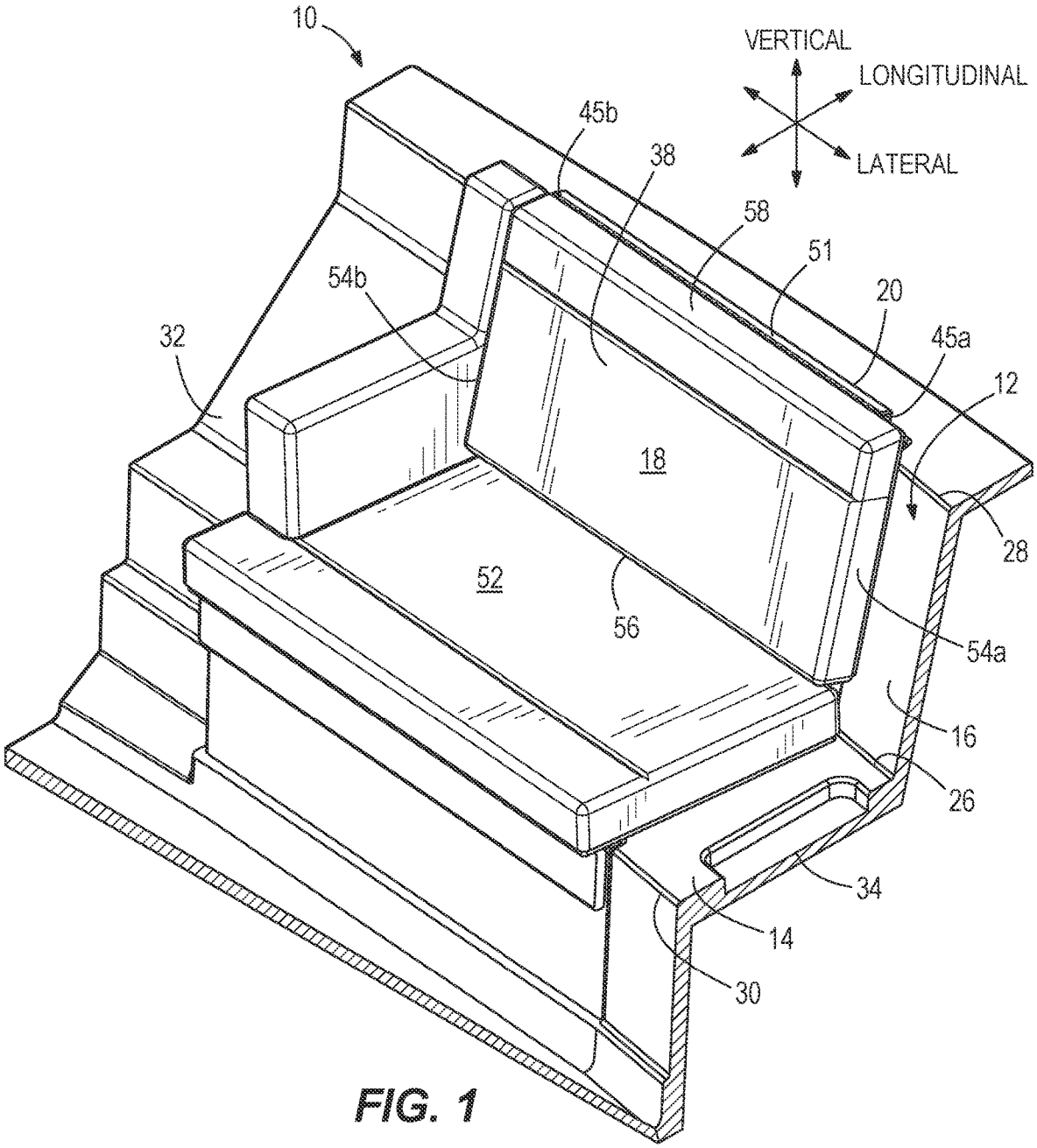
FIG. 1 shows a perspective view of a convertible seat.

FIG. 1 shows a convertible seat 10 which includes a seat base 12. The seat base 12 includes a seat bottom 14 which is joined to a seat back 16 at an intersecting location 26. The seat 10 extends vertically from the intersecting location 26 upwards toward a top end 28 of the seat back 14, longitudinally from the intersecting location 26 toward a front end 30 of the seat bottom 14, and laterally from a left side 32 to a right side 34.

Figure 2:
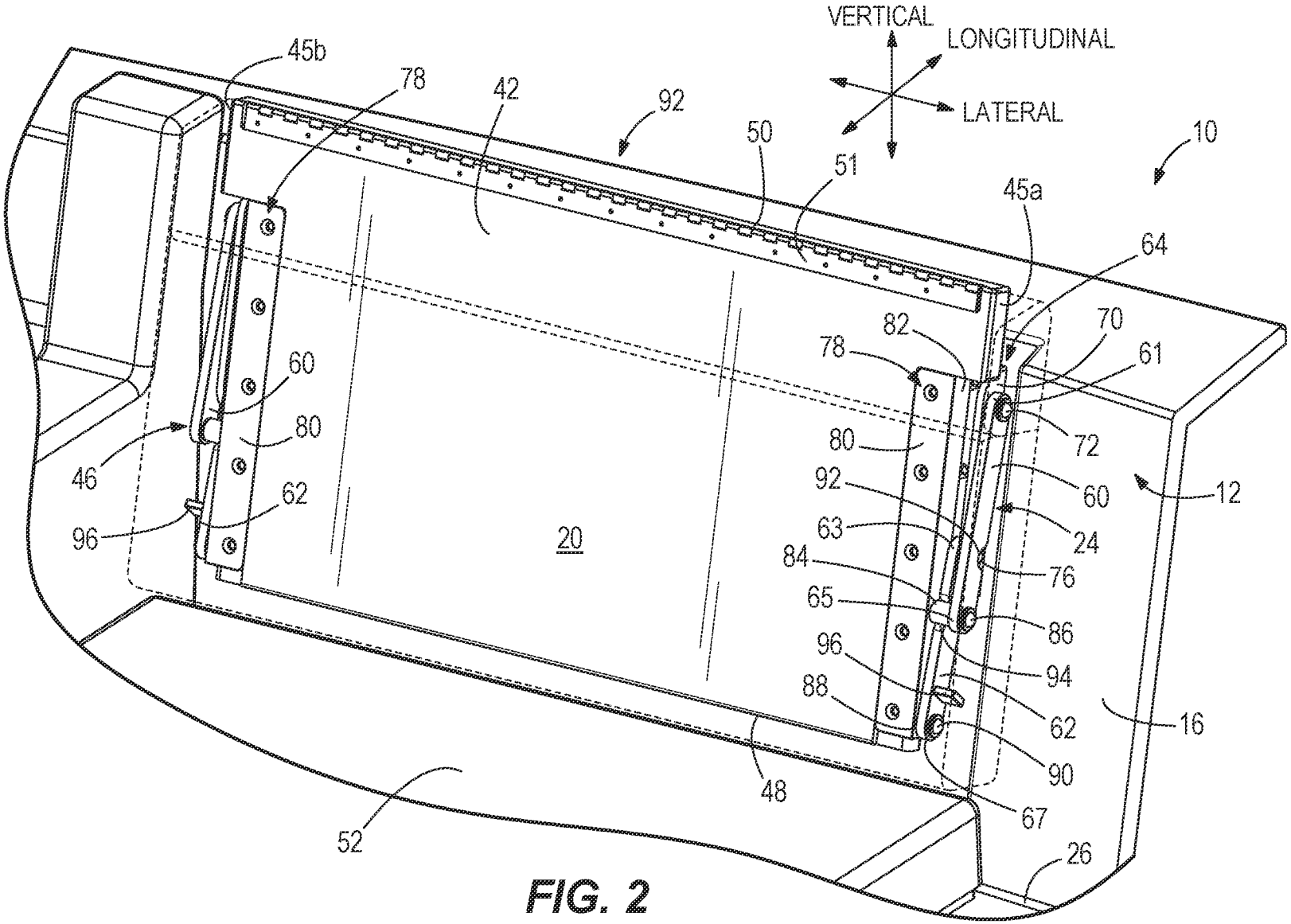
FIG. 2 shows a sectional view of the convertible seat in a stored position.
Figure 7:
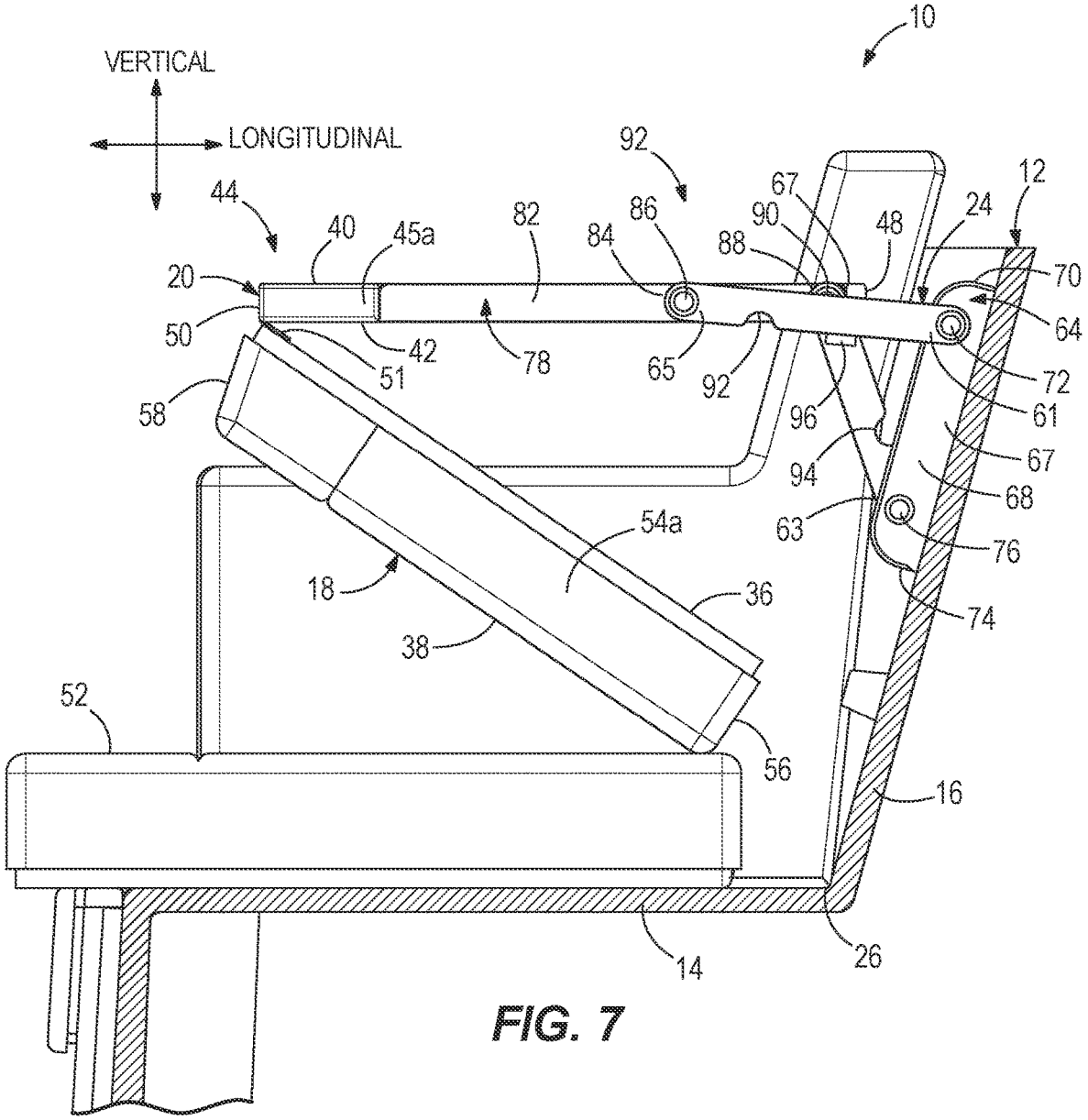
FIG. 7 shows a side view of the convertible seat in a deployed position.

The seat 10 further includes a back supporting cushion 18, a table 20, and a first pivot mechanism 24, and a second pivot mechanism 46 which together constitute a seatback assembly 44 capable of being pivoted into and between a stored position (FIG. 1) and a deployed position (FIG. 7). Referring to FIGS. 1-4, the back supporting cushion 18 extends laterally from a first side 54*a* to a second side 54*b*, substantially vertically from a lower end 56 to an upper end 58, and longitudinally from an inner face 36 to an outer face 38. The table 20 is sized such that the table 20 and the back supporting cushion 18 have substantially the same vertical and lateral dimensions. The table 20 is positioned longitudinally between the inner face 36 of the back supporting cushion 18 and the seat back 16. The table 20 extends vertically from a bottom end 48 to a top end 50, laterally from a first side 45*a* to a second side 45*b*, and longitudinally from top surface 40 to a bottom surface 42. The table 20 is coupled at the top end 50 to the back supporting cushion 18 at the upper end 58 via a piano hinge 51, as shown in FIG. 2, which extends laterally from the first side 45*a* to the second side 45*b*. As best shown in FIG. 5, the pivot mechanism 24 is pivotably coupled to the seat back 16 and pivotably coupled to the table 20 proximate the bottom end 48.

Figure 3:
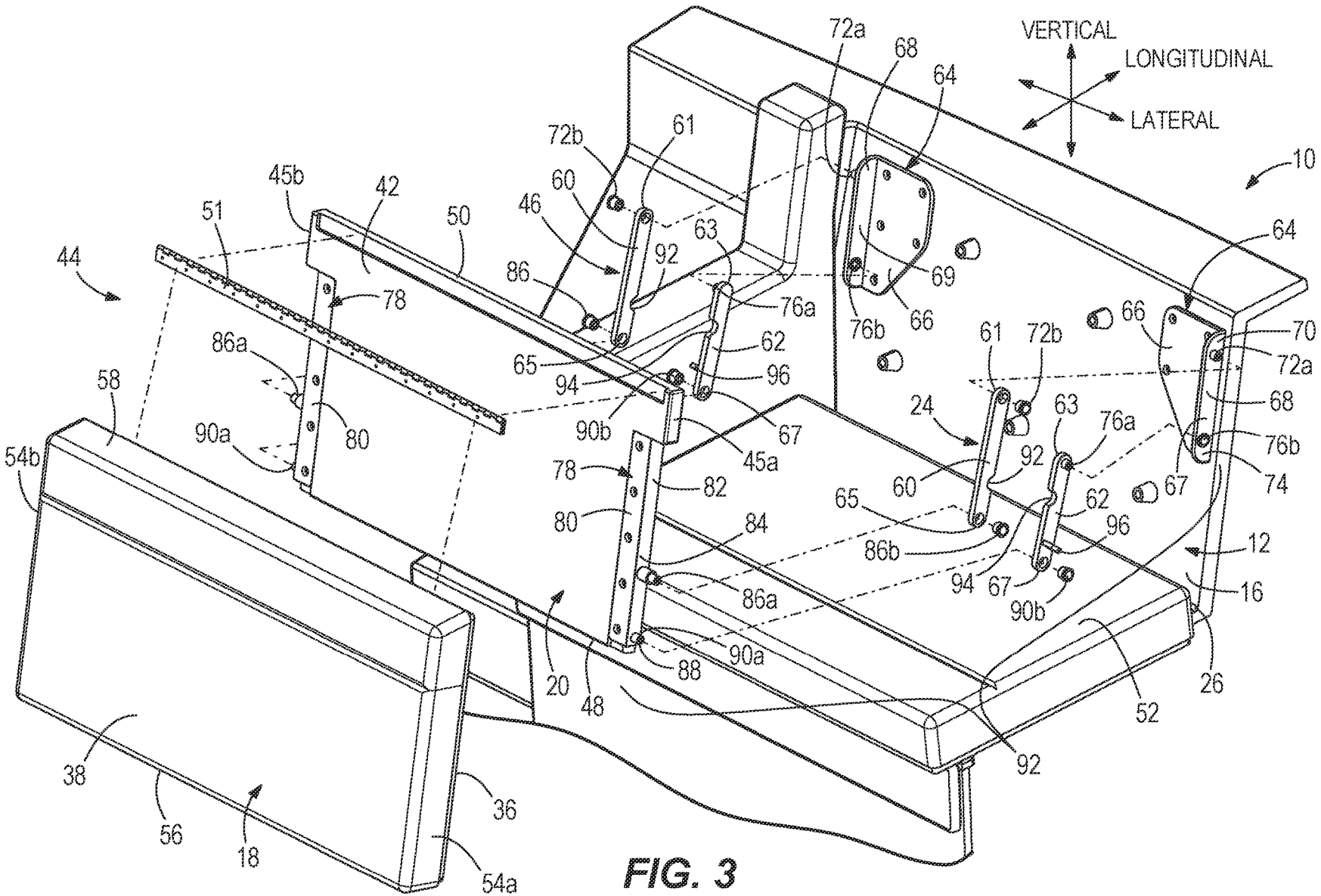
FIG. 3 shows an exploded view of the convertible seat.

Referring to FIGS. 2-3, the seat 10 further includes a seat bottom cushion 52 which is positioned vertically on top of the seat bottom 14 is configured to provide cushioning below an occupant seated on the seat 10. The second pivot mechanism 46 is positioned on the opposing side of the table 20 from the first pivot mechanism 24. The first pivot mechanism 24 is essentially a mirror image of the second pivot mechanism 46. As such, it should be understood that the following description of the first pivot mechanism 24 equally applies to the second pivot mechanism 46.

Referring to FIGS. 2-3, the pivot mechanism 24 includes an upper pivot arm 60 and a lower pivot arm 62. The upper pivot arm 60 and the lower pivot arm 62 are coupled to the seat back 16 via a base mounting bracket 64 and coupled to the table 20 via a table mounting bracket 78 such that the base mounting bracket 64, the upper pivot arm 60, the lower pivot arm 62, and the table 20 constitute a four-bar mechanism 92. The base mounting bracket 64 has a mounting face 66 which extends vertically and laterally and a seat base mounting flange 68 which extends vertically and longitudinally outward from the seat back 16. The mounting face 66 is secured to the seat back 16. The seat base mounting flange 68 has a first face 67 and a second face 69 which oppose one another laterally. The table mounting bracket 78 has a mounting face 80 which extends vertically and laterally and a table mounting flange 82 which extends vertically and longitudinally. The mounting face 80 is secured to the bottom surface 42 of the table 20 and the table mounting flange 82 is secured to the first side 45*a* of the table 20.

The upper pivot arm 60 and the lower pivot arm 62 each include an inner end 61, 63 and an outer end 65, 67 respectively. The upper pivot arm 60 is pivotably secured to an upper end 70 of the seat base mounting flange 68 via a first inner pivot joint 72. The lower pivot arm 62 is pivotably secured to a lower end 74 of the seat base mounting flange 68 via a second inner pivot joint 76. Relative to the seat bottom 14, the first inner pivot joint 72 is located vertically above the second inner pivot joint 76, and both remain stationary throughout deployment and storing of the seatback assembly 44. The upper pivot arm 60 is pivotably secured to a middle point 84 of the table mounting flange 82 via a first outer pivot joint 86. The lower pivot arm 62 is pivotably secured to a lower end 88 of the table mounting flange 82 via a second outer pivot joint 90. The upper pivot arm 60 further includes a downwardly facing cutout 92 positioned between the inner end 61 and the outer end 65. The lower pivot arm 62 further includes an upwardly facing cutout 94 and a support protrusion 96, wherein the upwardly facing cutout 94 is positioned between the inner end 63 and the outer end 67 and the support protrusion 96 is positioned at a middle portion between the inner end 63 and the upwardly facing cutout 94.

The first inner pivot joint 72, the second inner pivot joint 76, the first outer pivot joint 86, and the second outer pivot joint 90 each include a pin 72*a*, 76*a*, 86*a*, 90*a* and a fastener 72*b*, 76*b*, 86*b*, 90*b*, respectively. The pin 72*a* extends outward from the first face 67 of the seat base mounting flange 68 and through the inner end 61 of the upper pivot arm 60 where it is secured via the fastener 72*b*. The pin 76*a* extends outward from the inner end 63 of the lower pivot arm 62 and through the second face 69 of the seat base mounting flange 68 where it is secured via the fastener 76*b*. The pin 86*a* extends outward from the table mounting flange 82 and through the outer end 65 of the upper pivot arm 60 where it is secured via the fastener 86*b*. The pin 90*a* extends outward from the table mounting flange 82 and through the outer end 67 of the lower pivot arm 62 where it is secured via the fastener 90*b*. The pin 86*a* extends laterally further outward than the pin 90*a*. Such a configuration in combination with the pins 72*a*, 76*a* passing through opposing faces of the seat mounting flange 68 ensures that the upper pivot arm 60 and the lower pivot arm 62 remain adjacent to one another, but are not laterally co-planar.

Figure 4:
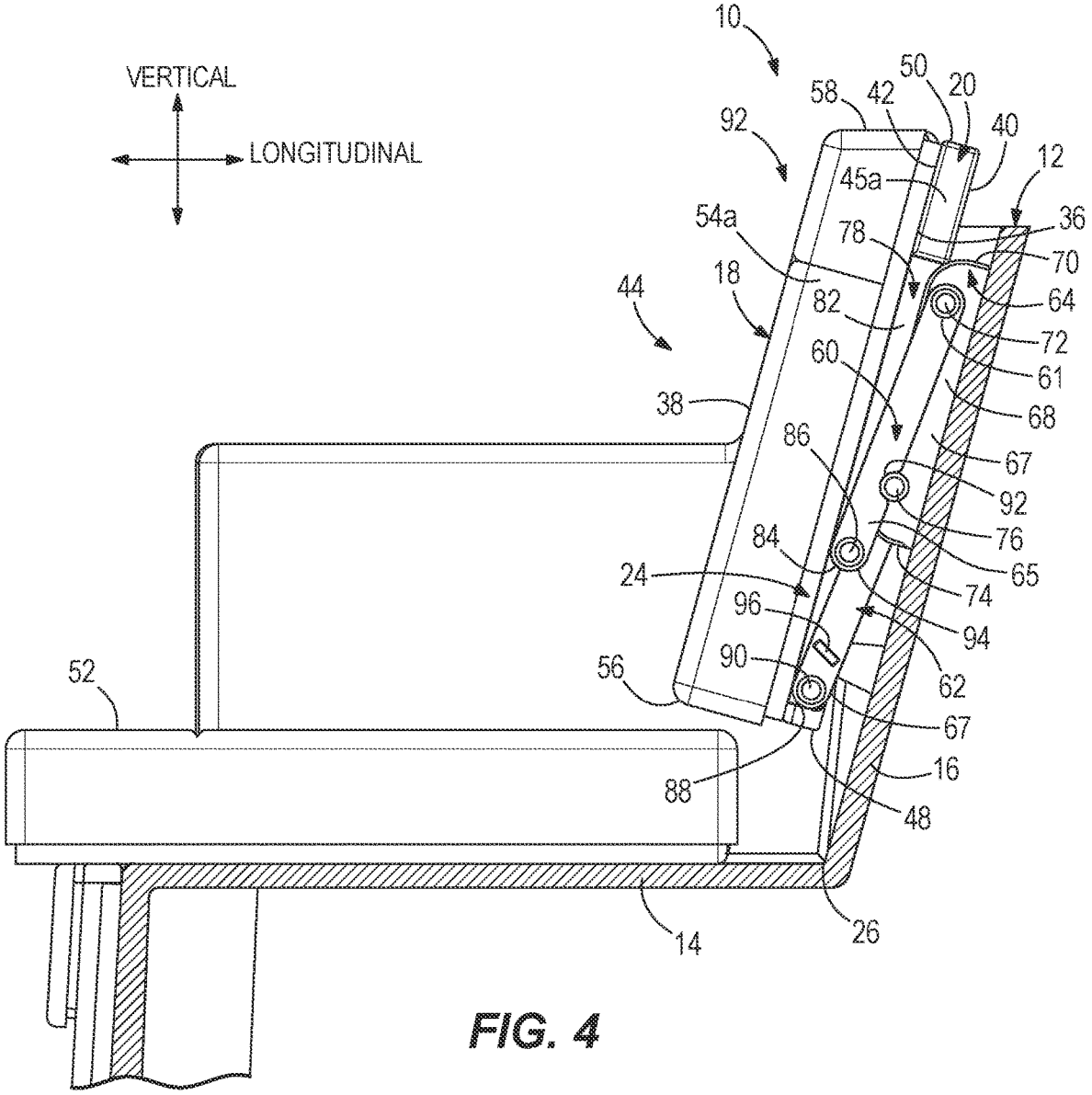
FIG. 4 shows a side view of the convertible seat in the stored position.
Figure 5:
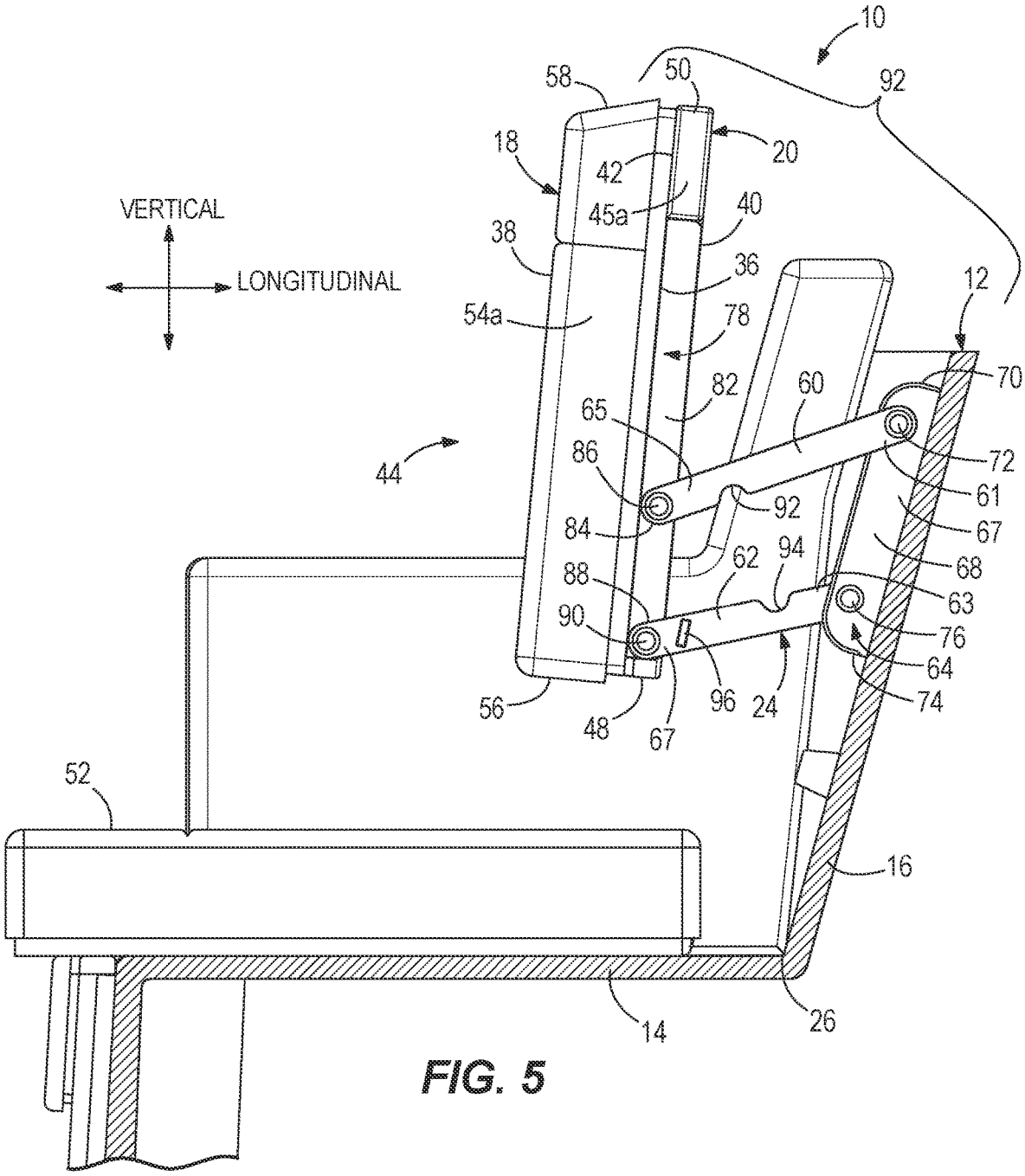
FIG. 5 shows a side view of the convertible seat in a first intermediate deployment position.

In use, as shown in FIGS. 4-7, the seatback assembly 44 is pivotable into and between the stored position and the deployed position. In the stored position, as shown in FIG. 4, the four bar mechanism 92 is compressed, such the table 20 is sandwiched between the seat back 16 and the back supporting cushion 18 and the inner face 36 of the back supporting cushion 18 and the bottom surface 42 of the table 20 abut one another. The pivot mechanism 46 is oriented such that the upper pivot arm 60 and the lower pivot arm 62 are generally adjacent to and aligned vertically with the table 20 and each other. In the stored position, the first outer pivot joint 86 and the second outer pivot joint 90 are located vertically below the first inner pivot joint 72 and the second inner pivot joint 76 such that the first outer pivot joint 86 is located between the second inner pivot joint 76 and the second outer pivot joint 90. Furthermore, the first outer pivot joint 86 is nested within the upwardly facing cutout 94 of the lower pivot arm 62 and the second inner pivot joint 76 is nested within the downwardly facing cutout 92 of the upper pivot arm 60.

Figure 6:
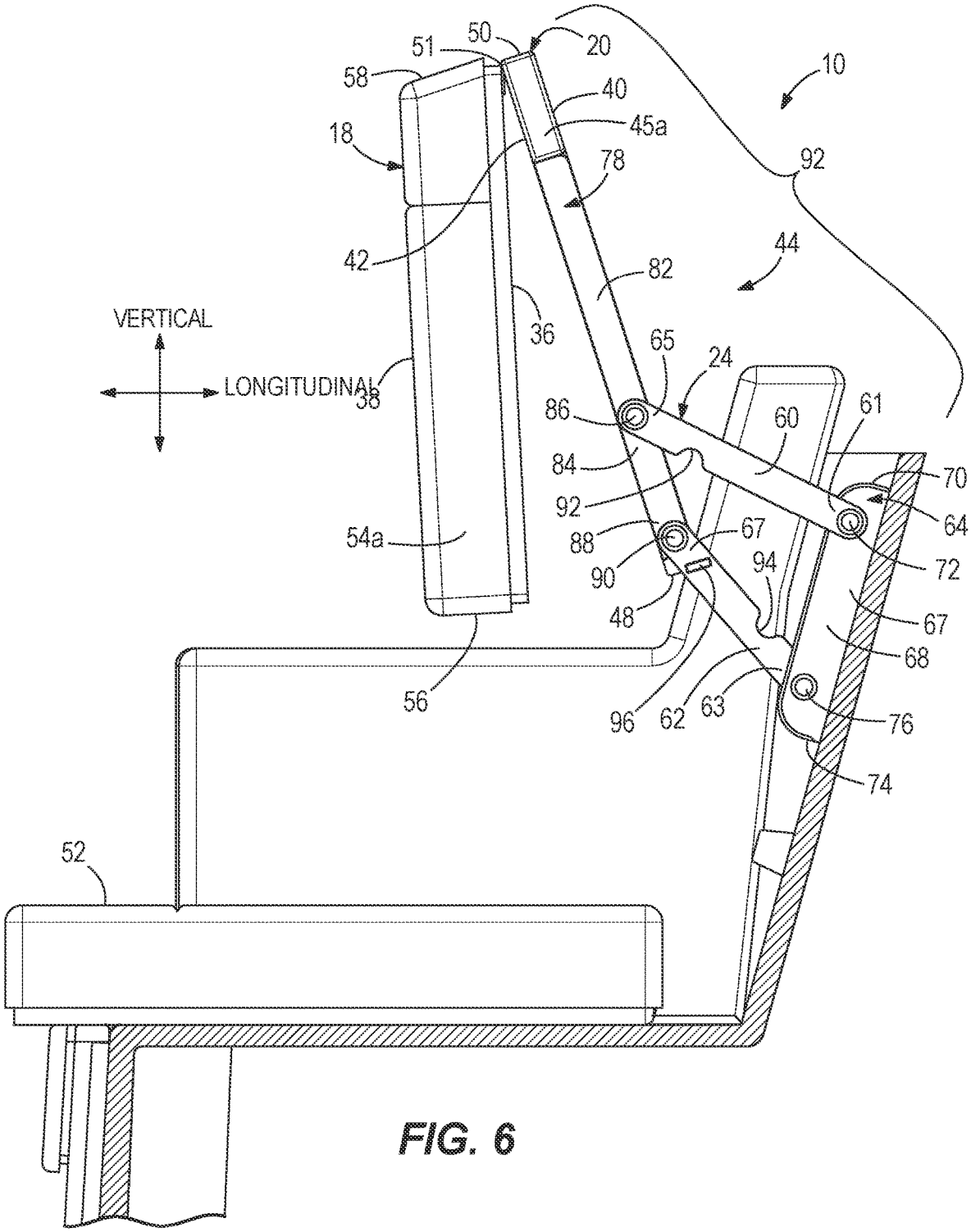
FIG. 6 shows a side view of the convertible seat in a second intermediate deployment position.

During deployment, as shown in FIGS. 5-6, the four bar mechanism 92 is extended and the pivot mechanism 46 is pivoted into two intermediate positions before pivoting the seatback assembly 44 into the deployed position. In the first intermediate position, as shown in FIG. 5, the back supporting cushion 18 and the table 20 are moved upward, thus pivoting the upper pivot arm 60 and the lower pivot arm 62 such that the first outer pivot joint 86 and the second outer pivot joint 90 are moved vertically upward and longitudinally outward with respect to the seat base 12. The back supporting cushion 18 and the table 20 remain vertically aligned and adjacent one another such that the inner face 36 of the back supporting cushion 18 and the bottom surface 42 of the table 20 abut one another.

In the second intermediate position, as shown in FIG. 6, the back supporting cushion 18 and the table 20 are moved further upwards and pivoted outward with respect to the seat base 12. The upper pivot arm 60 is pivoted such that the first outer pivot joint 86 is moved further upwardly and outwardly with respect to the seat base 12. The lower pivot arm 62 is pivoted such that the second outer pivot joint 90 is moved further upwardly with respect to the seat bottom 14 and inwardly with respect to the seat back 16. The inward movement of the second outer pivot joint 90 pivots the top end 50 of the table 20 about the hinge 51 such that the table 20 is angled upwardly and outwardly with respect to the seat back 16 and the back supporting cushion 18 remains substantially vertical.

To pivot the seatback assembly 44 into the deployed position, as shown in FIG. 7, the top end 50 of the table 20 and the upper end 58 of the back supporting cushion 18 are pivoted downward with respect to the seat back 16 until the table 20 is substantially horizontal and provides a supporting surface over the seat bottom 14 and the back supporting cushion 18 hangs downwardly from the top end 50 of the table 20. The top surface 40 of the table 20 faces upward in a position for supporting an article, the back supporting cushion 18 remains pivotably coupled to the table 50 via the hinge 51, and the lower end 56 of the back supporting cushion 18 lies in contact with the bottom cushion 52. The upper pivot arm 60 is pivoted such that the first outer pivot joint 86 is moved downwardly with respect to the seat bottom 14 and further outwardly with respect to the seat back 16. The lower pivot arm 62 is pivoted such that the second outer pivot joint 90 is moved further upwardly with respect to the seat bottom 14 and further inwardly with respect to the seat back 16 until the second outer pivot joint 90 resides between the first inner pivot joint 72 and the first outer pivot joint 86. The upper pivot arm 60 is held in a horizontal orientation by the support protrusion 96 on the middle portion of the lower pivot arm 62. The lower pivot arm 62 is oriented at upwardly and outwardly with respect to the seat base 12 such that the lower pivot arm 62 provides an angular bracing support for the upper pivot arm 60. To move the setback assembly 44 from the deployed position into the stowed position, the previous steps are carried out in reverse order.

What is claimed is:

1. A convertible seat for a marine vessel, the convertible seat extending from top to bottom in a vertical direction, from a first side to a second side that is opposite the first side in a lateral direction that is perpendicular to the vertical direction, and from front to back and a longitudinal direction that is perpendicular to the vertical direction and perpendicular to the lateral direction, the convertible seat comprising:

a seat base comprising a seat bottom and a seat back which extends transversely upwardly relative to the seat bottom, a seatback assembly comprising a back supporting cushion for an occupant seated on the seat bottom and a table coupled to the back supporting cushion, a pivot mechanism that couples the seatback assembly to the seat base, the pivot mechanism being configured such that the seatback assembly is movable relative to the seat base into a storage position in which the table is sandwiched between the seat back and the back supporting cushion and alternately into a deployed position in which the table provides a supporting surface over the seat bottom, the pivot mechanism including an upper pivot arm and a lower pivot arm that are pivotably coupled to the seat base and to the seatback assembly, wherein in the deployed position the lower pivot arm extends transversely to and provides bracing support for the upper pivot arm, and further wherein in the storage position the upper pivot arm and the lower pivot arm are collapsed in a laterally overlapping position relative to each other alongside the seatback assembly, and a supporting protrusion that laterally extends from a side of the lower pivot arm, the supporting protrusion configured to support the upper pivot arm when the seatback assembly is in the deployed position, wherein the upper pivot arm is pivotably coupled to the seat base at a first inner pivot joint and to the seatback assembly at a first outer pivot joint, and wherein the lower pivot arm is pivotably coupled to the seat base at a second inner pivot joint located below the first inner pivot joint and to the seatback assembly at a second outer pivot joint, wherein the upper pivot arm between the first inner pivot joint and the first outer pivot joint is straight and wherein the lower pivot arm between the second inner pivot joint and the second outer pivot joint is straight, and wherein the upper pivot arm comprises a cutout between the first inner pivot joint and the first outer pivot joint that nests the second inner pivot joint in the laterally overlapping position and wherein the lower pivot arm comprises a cutout between the second inner pivot joint and the second outer pivot joint that nests the first outer pivot joint in the laterally overlapping position.

2. The convertible seat according to claim 1, wherein the upper pivot arm and the lower pivot arm are pivotably coupled to a side of the table.

3. The convertible seat according to claim 2, wherein the upper pivot arm and the lower pivot arm in the laterally overlapping position are located laterally alongside of the table and entirely longitudinally forwardly of the seat base.

4. The convertible seat according to claim 1, wherein in the storage position the upper pivot arm and the lower pivot arm are located laterally alongside the table and entirely longitudinally between the back supporting cushion and the seat base.

5. The convertible seat according to claim 1, further comprising a bracket that couples the upper pivot arm and the lower pivot arm to the seat base, and wherein the upper pivot arm and the lower pivot arm in the laterally overlapping position are located laterally between the seatback assembly and the bracket.

6. The convertible seat according to claim 5, wherein the upper pivot arm and the lower pivot arm are mounted to opposite sides of the bracket, respectively.

7. The convertible seat according to claim 1, wherein the upper pivot arm and the lower pivot arm are a first upper pivot arm and a first lower pivot arm which are located proximate to the first side of the seatback assembly, and further comprising a second upper pivot arm and a second lower pivot arm that are pivotably coupled to the seat base and the seatback assembly at a location proximate to the second side of the seatback assembly, wherein in the storage position the second upper pivot arm and the second lower pivot arm are collapsed in a laterally overlapping position relative to each other.

* * * * *